United States Patent [19]

Bedford

[11] 3,941,553

[45] Mar. 2, 1976

[54] HEATER SAFETY CONTROL SYSTEM

[75] Inventor: Robert E. Bedford, Canoga Park, Calif.

[73] Assignee: Scheu Manufacturing Company, Upland, Calif.

[22] Filed: Oct. 29, 1974

[21] Appl. No.: 518,750

[52] U.S. Cl. ..... 431/80

[51] Int. Cl.[2] ..... F23H 5/10

[58] Field of Search ..... 431/71, 78, 69, 27, 80

[56] References Cited

UNITED STATES PATENTS

| | | | |
|---|---|---|---|
| 3,630,648 | 12/1971 | Hulsman | 431/80 |
| 3,689,194 | 9/1972 | Das et al. | 431/80 |
| 3,847,533 | 11/1974 | Riordam | 431/78 |

*Primary Examiner*—Edward G. Favors
*Attorney, Agent, or Firm*—Fleit & Jacobson

[57] ABSTRACT

A safety control system for use on a heater which shuts off the heater fuel supply if the heater flame is not present within a predetermined time after initial ignition is attempted or after re-ignition is attempted should the flame be extinguished. A flame sensor which makes use of the electrical conductivity of the flame is employed with a solid-state switch, silicon controlled rectifier, and time delay relay to provide a fast response control circuit for shutting off the fuel supply valve in the absence of flame after a predetermined delay.

15 Claims, 3 Drawing Figures

HEATER SAFETY CONTROL SYSTEM

BACKGROUND OF THE INVENTION

In all heaters, burners or furnaces where a flame is present, safety is always of the utmost importance. One condition which must be considered by a safety system is the absence of flame in the presence of fuel either during operation or at some time after start up. A safety control system which has been used successfully for many years employs a thermally responsive element to sense the presence of flame and a thermal time delay relay. The thermally responsive element detects a flame, or the lack thereof, while the thermal time delay relay is utilized in the safety control system when a flame is not present. In other words, a time delay is provided during start up so that sufficient time is allowed for the fuel to be ignited and heater operation to begin, or if the flame is extinguished during operation the delay provides sufficient time for re-ignition before the fuel supply is shut off.

Although such safety systems have found wide use, the American National Standards Association now recommends a maximum time in which the fuel supply must be shut off in the event that ignition does not occur or if the flame is extinguished. The thermally responsive flame sensor currently in use has a response time of approximately 30 seconds, for both heating and cooling. This response time then sets the minimum response time for the time delay relay, since it must have a longer response time to avoid unplanned shut down of the heater while attempts are being made at start up. The typical time delay for relays of this type currently in use is 45 seconds. The resulting thermal response time for such known safety systems exceeds the maximum time from flame-out to fuel valve closure which is recommended by the American National Standards Association for heaters of the flame-forced air type. Therefore, either a faster thermally responsive element must be found or a different approach adopted in providing this most important safety feature for flame heaters.

SUMMARY OF THE INVENTION

The present invention provides a heater safety control system having a fast response time which meets all current specifications. A solid state electronic control circuit is provided in combination with a flame detector which operates by using the electrical conductivity properties of a flame, rather than being thermally responsive. A voltage is applied to an electrode immersed in the flame and the heater structure is grounded. The presence of a flame permits a small current to flow, which is then utilized by the control system of the present invention. A transistor driven by the flame sensor controls a silicon controlled rectifier which serves to energize a relay and switch, as well as a time delay relay in the form of a resistance heating element, used for start up and re-ignition. A trial ignition period is provided by the time delay relay and at the end of the time either shuts off the fuel supply or permits heater operation, depending upon the state of the transistor switch circuit. A resistor matched to the impedance of the fuel valve solenoid is used to keep open the fuel line so that ignition may be attempted in the absence of a flame.

If ignition does not occur during the trial period provided by the delay relay, power is interrupted by that relay and the fuel valve is closed, the ignitor is de-energized and the heater is shut down. However, power is still applied to the delay relay and switch so that the heater does in fact remain shut down.

If the flame is extinguished during normal operation, the transistor and silicon controlled rectifier act to energize the delay relay and re-ignition is attempted. As before, if re-ignition is not successful during the trial period provided by the delay relay, the safety switch opens and the heater is shut down as described above.

The present invention also provides its own fail-safe provisions to ensure safe heater operations in the event of failure of certain components in the control circuit itself. The circuit is arranged such that if the silicon controlled rectifier fails, the safety switch and delay relay will remain continuously energized, thereby permitting the gas valve to remain closed. A fail-safe provision is also provided in the event that the flame sensing electrode becomes shorted to ground, thereby falsely indicating the presence of a flame. If such occurrence takes place, burner start up is prevented by the internal time sequence of the control circuit of the invention, which ensures that the transistor switches on before the silicon controlled rectifier is triggered, thereby preventing energization of the relay, which is under the control of the silicon controlled rectifier, and preventing the fuel valve from opening.

It is therefore an object of the present invention to provide a fast acting safety control system for use on a flame heater.

It is another object of the present invention to provide a heater safety control system which uses a flame conduction flame sensor in combination with a delay relay.

It is a further object of the present invention to provide a flame heater safety control system utilizing a conduction flame sensor, a delay relay and a solid state control circuit.

It is still a further object of the present invention to provide a flame heater safety control system utilizing a conduction flame sensor, solid state switch, and silicon controlled rectifier to operate a relay for controlling the fuel valve of the heater to permit ignition.

DESCRIPTION OF THE PREFERRED EMBODIMENT

Figure 1:
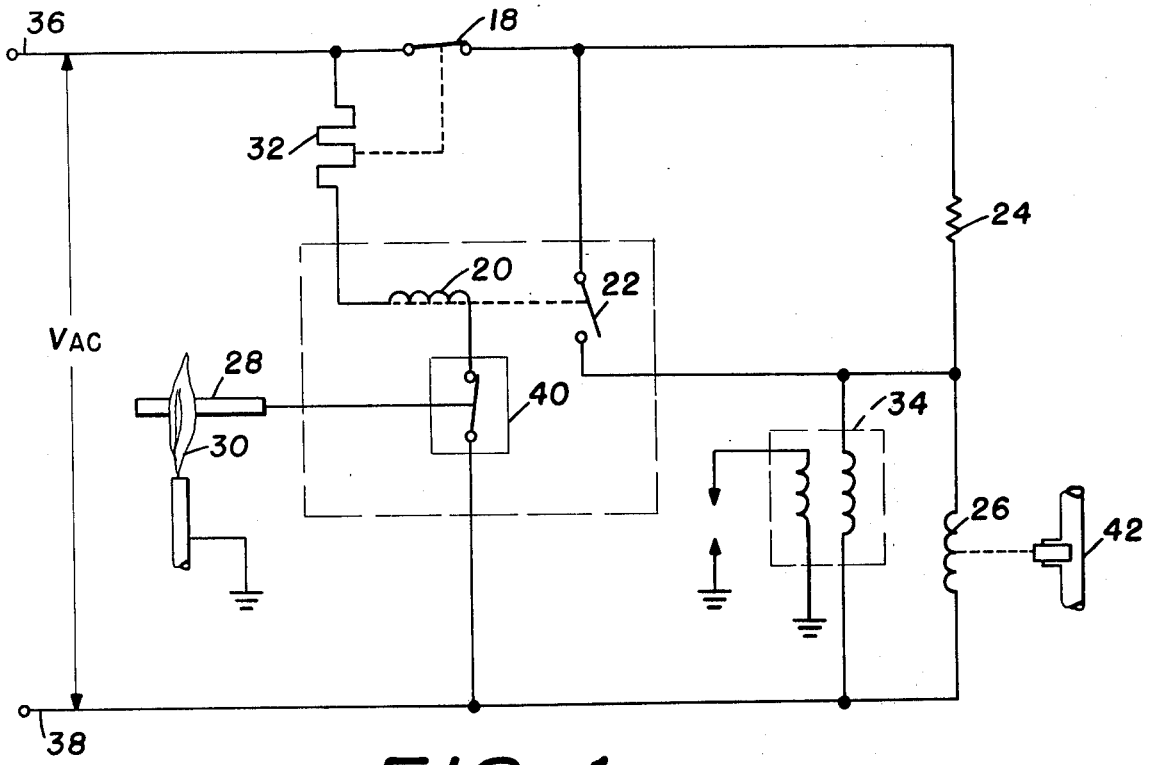
FIG. 1 is a schematic diagram of a conventional control system in use on forced air heaters.

Referring now to FIG. 1, a safety control system used in the past is shown in schematic form. Components which are functionally fundamental to this type of safety control system are: a normally closed switch 18, a normally open relay 20 and switch 22, and a matched resistor 24 and solenoid fuel valve 26. A flame rod 28 is located such that it will be enveloped in the heater flame 30. A thermal time delay relay 32 and an ignitor 34 are also employed in this type of heater safety control. In operation, an alternating current voltage is impressed across this control system at electrical conductors 36 and 38. The flame rod or flame sensor 28 is a thermally responsive element which cooperates with a normally closed flame switch 40. During operation of the heater, the flame switch relay 20 closes the switch 22, thereby energizing the fuel valve solenoid 26 which permits heater fuel to flow through pipe 42 thereby allowing the heater to operate in the intended manner. The normally closed flame switch 40 concurrently actuates the thermal time delay relay 32 and switch 18. When the flame rod 28 thermally senses the presence of the flame 30, the flame switch 40 opens. This terminates the safety timing cycle by blocking current flow through the relay 20 and hence opening switch contacts 22, and also interrupts the original current path to the gas valve solenoid 26. However, the gas valve solenoid 26 is held open by way of the electrical continuity through the matched resistor 24, which is now electrically in series with the gas valve solenoid 26.

In the event that flame 30 should be lost, the flame switch 40 closes thereby actuating the safety timing cycle, i.e., the thermal time delay relay 32. Continuous current flow through this delay relay 32 opens switch 18 after the preset time has elapsed. The opening of switch 18 therefore interrupts current flow through line 36 and deenergizes the gas valve solenoid 26. When the switch actuated by the gas valve solenoid 26 closes, all fuel flow in pipe 42 ceases and no fuel is supplied until ignition is attempted again.

As mentioned previously, the flame sensing element 28 used in this type of prior art safety control system is a thermally responsive element which has a relatively long response time. Flame sensing elements of this type have a typical response time of 30 seconds for both heating and cooling. Such long response time then means that the thermal time delay relay 32 must have an even longer response time in order to avoid unplanned and undesired shut downs when the heater is initially being started up. It is this long time delay which the present invention shortens for heaters of this type.

Figure 2:
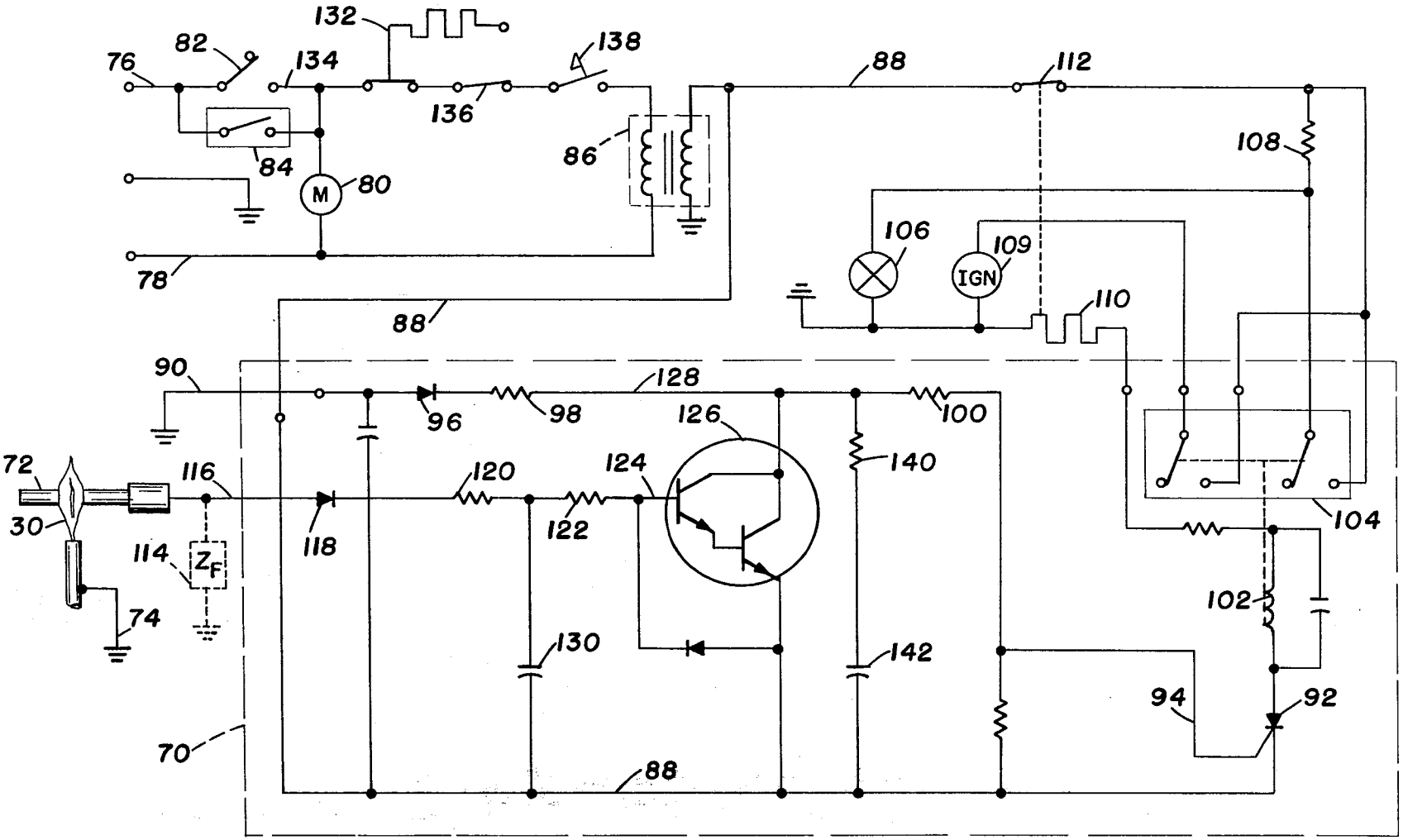
FIG. 2 is a schematic diagram of the preferred embodiment of the present invention combined with a forced air heater.

Turning now to FIG. 2, the present invention is shown in schematic form in combination with a complete heater apparatus. The flame switch provided by the present invention is shown generally at 70. This flame switch 70 is intended for use with a different type of flame sensor than has been used in the past. More specifically, in place of the thermal flame sensing element 28 of FIG. 1, an electrically conductive flame sensor is used. An electrode or flame rod 72 is immersed in the flame 30 and the heater structure from which the flame 30 issues is then grounded, as shown at 74. When a suitable potential difference exists between the flame rod 72 and ground, and a flame is present, a small current will flow through the conductive flame. This current flow is permitted by the large number of ionized gas particles present in the flame itself. The present flame switch 70 serves to utilize this small current flow through the flame to operate a heater safety control system.

An alternating current voltage, typically 110 volts, 60 Hertz, is applied across terminals 76 and 78 and energizes a fan motor 80 by either an on/off switch 82 or a thermostat 84. An isolation transformer 86, connected in parallel across the fan motor 80, supplies the power on line 88 to the flame switch 70, with the electrical return being to ground on line 90. Upon the application of current through line 88, a silicon controlled rectifier 92 is triggered into conduction during the negative half-cycle by the application of a signal on line 94 to the gate of the silicon controlled rectifier 92 through resistors 98 and 100, and rectifier 96. As a result of the silicon controlled rectifier 92 being triggered into conduction by the gate signal on line 94, a relay coil 102 is energized and a normally open two-line switch 104 is closed and the burner operation is initiated.

Upon actuation of switch 104 the current through line 88 energizes a gas valve 106, bypassing resistor 108, and permitting fuel to flow to the heater. Switch 104 in its closed position also energizes an ignitor 109 for starting the burner. At the same time the silicon controlled rectifier 92 energizes the relay 102, a safety switch heater 110 is also energized. This provides the thermal time delay discussed previously. The safety switch contacts 112 are located in the electrical line 88 and the switch 112 is mechanically linked to the heater 110, switch 112 opening upon a current passing through heater 110 for a predetermined trial ignition period. Energization of the switch heater 110 initiates the timing of the trial ignition period.

Upon ignition, the flame 30 provides a current path between the flame rod 72 and ground 74 thereby completing the circuit. The effective impedance of the flame $Z_F$ is shown at 114 for circuit analysis purposes. Electrical conduction through the flame 30 occurs during the negative half-cycle of the alternating current voltage applied across lines 76 and 78.

Now, tracing the current flow and using the neutral or return line as an arbitrary starting point, current flow proceeds through the heater structure shown grounded at 74 and through the flame 30 to the flame rod 72. Current flow then proceeds from the flame rod 72 on line 116 through a diode 118 and resistors 120 and 122 to the base lead 124 of a Darlington stage type semiconductor device 126. This Darlington stage is a well-known common-collector configuration and is commercially available as a unified structure device.

The semiconductor device 126 is driven into conduction by the flow of base current on line 124. The current on line 128, through diode 96 and resistors 98 and 100, is now shunted away from the gate lead 94 of semiconductor controlled rectifier 92 by the semiconductor device 126 to return to line 88. Therefore, the silicon controlled rectifier 92 is no longer triggered into half-wave conduction, and both the relay coil 102 and the safety switch heater 110 are de-energized. However, the gas valve solenoid 106 remains energized or open due to the current flow through the matched resistor 108, and the heater remains in operation. A portion of the current through flame 30 is passed by resistor 120 and is used to charge a capacitor 130 which subsequently discharges during the positive half-cycle to maintain the base current on line 124 to maintain the semiconductor device 126 in its conductive state.

If ignition does not occur during the aforementioned trial ignition period, resistance heating of the safety switch heater 110 causes the safety switch contacts 112 to open and interrupt the power to the gas valve 106 and the ignitor 109, thereby effecting heater shutdown. However, the silicon controlled rectifier 92 continues to conduct, since voltage is being supplied by line 88 and the gate current will be present on line 94, and this conduction maintains energization of the relay coil 102 and safety switch heater 110 which serves to hold the safety switch contacts 112 open. In other words, the present system is arranged such that even though the safety switch interrupts the power to the gas valve 106, power is still available to keep the safety system 70 actuated in order to keep the power interrupted until another trial period can be re-initiated.

In the event that the flame 30 is extinguished after ignition has occurred, i.e., during normal operation, the base current on line 124 is interrupted and the semi-conductor device 126 is permitted to return to its non-conductive state. This forces the current on line 128 through resistor 100 and line 94 to the gate of the silicon controlled rectifier 92, thereby triggering rectifier 92 into its conductive state. Upon conduction, the relay coil 102 is energized and switch 104 is thrown and the safety switch heater 110 is energized. In this switch state, the gas valve solenoid 106 remains open, the ignitor 109 is energized and re-ignition is attempted. If re-ignition is not successful during the trial period, i.e., during the time delay provided by the safety switch heater 110, then the safety switch 112 contacts open and the heater is shut down as described above.

It can then be seen from the foregoing description that the slow response time associated with past heater safety systems, as shown for example in FIG. 1, has been eliminated and a fast acting solid state system provided for its replacement. The flame switch 70 of the present invention uses only one thermally responsive element in combination with solid state switching devices to provide a precise safety control without excessive time delays. Moreover, all possible contingencies are provided for in the present invention, i.e., both failure of ignition during start up, and the extinguishment of the flame during operation.

The overall heater assembly as shown in FIG. 2 contains further safety features, in addition to those provided by the flame switch 70. A high limit temperature switch 132 is located in the main power line 134 to the isolation transformer 86 and, upon the occurrence of an extremely high temperature, power is interrupted and the gas valve solenoid 106 will be closed. It should be noted that the fan motor 80 remains energized to aid in dissipating the excessive heat. A tip-over switch 136 is also located in line 134 and also interrupts power to the gas valve solenoid 106 in the event the heater becomes jarred out of its intended operating position. A conventional mercury-type switch may be utilized as the tip-over switch 136. Lastly, an air pressure switch 138 is provided in line 134. This switch 138 is in the normally open position and will not close until the fan motor 80 is up to speed and providing sufficient air flow to dissipate the heat of the burner.

Figure 3:
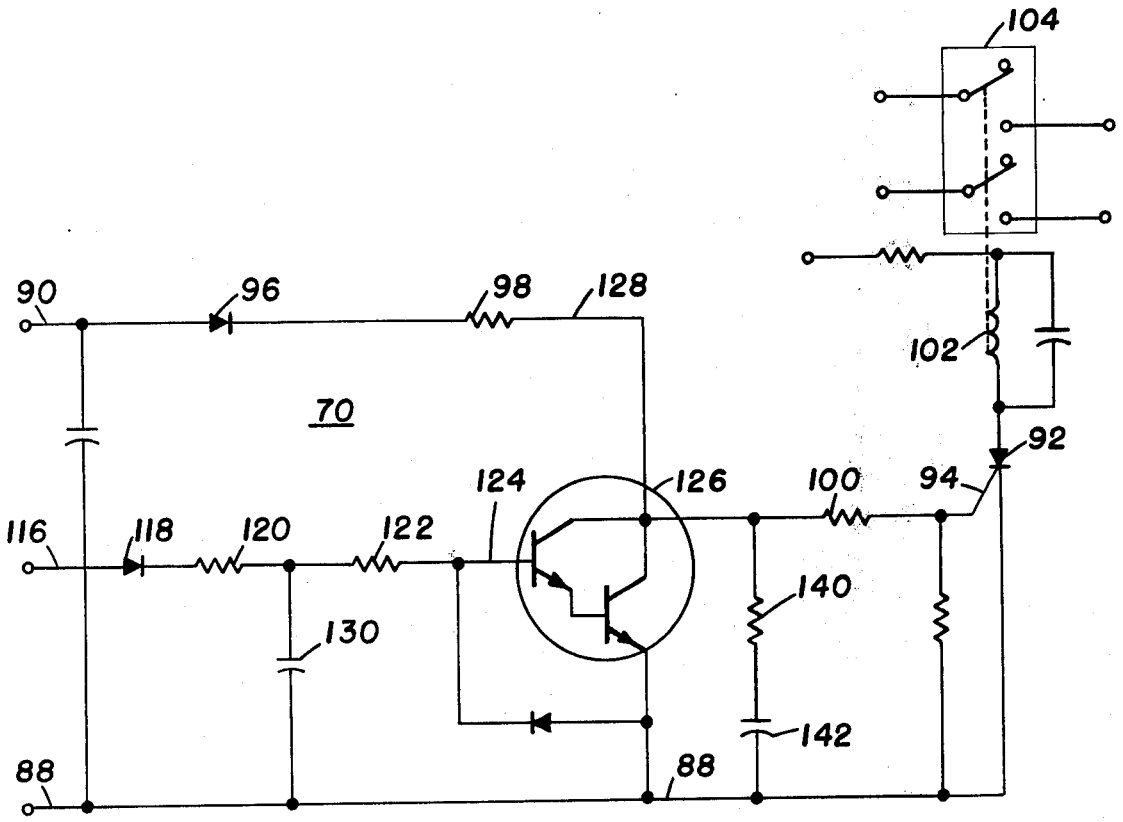
FIG. 3 is a schematic diagram of the electrical circuit of the present invention.

Referring now to FIG. 3, the flame switch 70 is shown in schematic form, and removed from the entire heater of FIG. 2 in order to better describe it. The flame switch system 70 provided by the present invention also incorporates fail-safe provisions in the event of certain key component failures. One such key component is the silicon controlled rectifier 92 and of importance is its failure in the shorted mode so as to remain continuously conductive and therefore insensitive to the flame rod sensor. The flame rod sensor 72 of FIG. 2 is also a critical component and its potential failure mode is a breakdown of its insulation so that the rod is shorted to the heater structure, thereby falsely indicating the presence of a flame. In the case of the failure of the silicon controlled rectifier 92 being continuously conductive, the safety switch relay 102 and safety switch heater 110 remain energized and the gas valve solenoid 106 of FIG. 1 will remain closed. In the event that the flame rod becomes shorted or exhibits an unusualy low impedance $Z_F$ shown at 114 in FIG. 2 to the heater structure, the heater is prevented from starting by the invention by providing appropriate timing of the flame switch 70 operation. More particularly, the flame switch is designed so that the semi-conductor device 126 switches ON before the silicon controlled rectifier 92 is triggered, thereby preventing energization of the relay and opening of the gas valve. This timing sequence is achieved by resistors 98 and 140 and capacitor 142 which act to delay the gate signal on line 94 for an interval sufficient to ensure that the semi-conductor device 126 switches ON before the silicon controlled rectifier 92 under these failure conditions.

It should be understood that the details of the foregoing embodiment are set forth by way of example only. The thermal time delay need not be a thermal type delay but may be any type of time delay such as a multivibrator with an internal time delay. Accordingly, it is contemplated that this invention not be limited by the particular details of the embodiment as shown, except as defined in the appended claims.

What is claimed is:

1. A safety control system for use in a flame-type heater to interrupt the supply of fuel to the heater in the absence of a flame, the safety control system comprising:

a burner assembly for developing a flame; first and second electrode means associating with said burner assembly so that an electrical circuit is completed between said first and second electrode means through and in the presence of a flame, and is interrupted in the absence of a flame; a source of electrical energy applied between said first and second electrode means; delay means for discontinuing the supply of fuel to the heater after the elapse of a predetermined interval of time from the interruption of said circuit; first switch means in the circuit of said first and second electrode means, responsive to the interruption of the electrical circuit between said first and second electrode means, taking a first operational state when said circuit is completed and a second operational state when said circuit is interrupted; and second switch means in the circuit of said first switch means and said delay means, responsive to the operational state of said first switch means, for disabling said delay means when said first switch means is in its first operational state, and actuating said delay means when said first switch means is in its second operational state to thereby commence the sensing of said predetermined interval of time.

2. A safety control system for use on a flame-type heater having a burner fed by a fuel supply line with an actuatable valve therein, an ignitor, a start switch for initiating burner operation and a voltage source, said safety control system comprising:

first normally closed switch means having a first terminal connected to said voltage source for delivering electrical energy to the actuatable valve and the ignitor, and a second terminal, said switch opening upon actuation;

second switch means having a first terminal connected to the second terminal of said first switch means, a second terminal connected to said actuatable valve, a third terminal connected to said ignitor, said second switch means being selectably operable between a first mode wherein said second and third terminals are connected to said first terminal, and a second mode wherein said first, second and third terminals are independent from one another;

gate-controlled actuation means operably connected to said second switch means for placing said second switch means in its first mode when a signal is present at the gate of said actuation means, and for placing said second switch means in its second mode when no signal is present at the gate of said actuation means;

gate-controlled sensing means connected to said voltage source for shunting gating signals from the gate of said actuation means when a flame is sensed at said burner; and timing means operably connected to said first switch means and said actuation means for initiating a preset time period upon receiving energy from said actuation means when a signal is present at the gate of said actuation means, and for actuating said first switch means upon the completion of said time period should no flame be present, to thereby interrupt the supply of fuel to said burner.

3. The apparatus of claim 2 and further comprising:

an electrode postioned to be enveloped in the flame of said burner for completing an electrical circuit through said flame to the gate of said sensing means.

4. The apparatus of claim 3 wherein said timing means comprises a thermal delay relay.

5. The apparatus of claim 4 wherein said gate-controlled sensing means comprises a Darlington stage transistor amplifier.

6. The apparatus of claim 2 further comprising a resistor having an impedance matched to that of said actuatable valve and connected between said actuatable valve and said first switch means.

7. A safety control system which senses the absence of a flame and shuts off a fuel supply solenoid valve of a combustion heater having an electrically energized ignitor, said safety control system comprising:

flame detection means for producing an output signal upon the detection of said flame;

switch means electrically connected in series with said solenoid valve for disconnecting said solenoid valve from a voltage source upon actuation of said switch means;

relay means having a first switch contact connected to a voltage source, a second switch contact connected to said solenoid valve, a third switch contact connected to said ignitor, said relay means having a relaxed mode in which said first, second and third switch contacts are independent from one another, and an actuated mode in which said first, second and third switch contacts are connected together;

an actuation coil operably connected to said relay means for actuating said relay means to said actuated mode upon the absence of an output signal from said flame detection means; and time delay means actuated by the lack of an output signal from said flame detector means and operably connected to said switch means for actuating said switch means upon the elapse of a selected time period before an output signal is issued by said flame detector means.

8. The apparatus of claim 7 wherein said flame detection means comprises:

electric conductor means positioned to be enveloped in said flame for providing a path of electrical conductivity from said heater structure through said flame and to an output terminal of said conductor means, and amplifier means having an input connected to said output terminal for producing said output signal from said flame detection means.

9. The apparatus of claim 7 wherein said time delay means comprises a current sensitive thermal time delay relay.

10. The apparatus of claim 9 wherein said amplifier comprises a plurality of transistor stages connected in common collector configuration.

11. The safety control system of claim 1 wherein the first operational state of said first switch means shunts energy away from said second switch means, and wherein the second operational state of said first switch means enables the transmission of energy to said second switch means.

12. The safety control system of claim 11 wherein said second switch means is a silicon controlled rectifier, and wherein its gate receives said transmitted energy.

13. The safety control system of claim 1 wherein said second switch means is a silicon controlled rectifier, and wherein said first switch means is positioned between said second switch means and a source of gating energy, said first switch means shunting said gating energy away from said second switch means when said first switch means is in its first operational state.

14. The safety control system of claim 1 wherein said first switch means is a Darlington amplifier, and wherein said second switch means is a silicon controlled rectifier.

15. The safety control system of claim 14 wherein said first switch means, in its first operational state, shunts gating energy away from the gate of said second switch means.

* * * * *